US007797913B2

(12) United States Patent
Gorrieri et al.

(10) Patent No.: US 7,797,913 B2
(45) Date of Patent: Sep. 21, 2010

(54) METHOD AND MACHINE FOR PACKING GROUPS OF PRODUCTS ARRANGED IN ONE OR MORE LAYERS

(75) Inventors: Giordano Gorrieri, Bologna (IT); Moreno Cremonini, Bologna (IT); Mirko Cassoli, Bologna (IT)

(73) Assignee: KPL Packaging S.p.A., Bologna (IT)

( * ) Notice: Subject to any disclaimer, the term of this patent is extended or adjusted under 35 U.S.C. 154(b) by 102 days.

(21) Appl. No.: 12/083,802

(22) PCT Filed: Oct. 18, 2006

(86) PCT No.: PCT/IT2006/000746

§ 371 (c)(1),
(2), (4) Date: Jul. 2, 2008

(87) PCT Pub. No.: WO2007/046126

PCT Pub. Date: Apr. 26, 2007

(65) Prior Publication Data

US 2009/0139185 A1 Jun. 4, 2009

(30) Foreign Application Priority Data

Oct. 20, 2005 (IT) ..... BO2005A0630

(51) Int. Cl.
*B65B 11/48* (2006.01)
*B65B 49/12* (2006.01)

(52) U.S. Cl. ..... 53/466; 53/461; 53/228; 53/234

(58) Field of Classification Search ..... 53/461, 53/463, 466, 203, 209, 228, 230, 232, 233, 53/234

See application file for complete search history.

(56) References Cited

U.S. PATENT DOCUMENTS

| | | | | |
|---|---|---|---|---|
| 3,681,893 | A * | 8/1972 | De Barge | 53/209 |
| 4,083,163 | A * | 4/1978 | Ganz | 53/48.2 |
| 4,574,565 | A * | 3/1986 | Gambetti | 53/442 |
| 4,845,924 | A * | 7/1989 | Focke et al. | 53/438 |
| 4,918,901 | A * | 4/1990 | Gamberini et al. | 53/234 |
| 5,189,864 | A * | 3/1993 | Cinotti et al. | 53/439 |
| 5,269,117 | A * | 12/1993 | Boriani et al. | 53/234 |

(Continued)

FOREIGN PATENT DOCUMENTS

EP 1 227 040 A1 7/2002

(Continued)

*Primary Examiner*—Paul R Durand
(74) *Attorney, Agent, or Firm*—Breiner & Breiner, L.L.C.

(57) ABSTRACT

Method for packing groups of products or products of prismatic shape with rectangular or square base, which from a feed or grouping unit are then moved towards a first folding spindle so as to be delivered therefrom wrapped in the shape of a "U" rotated through 90° and open at the back, by a packing sheet which is previously placed in front of the spindle with vertical positioning, characterized in that the product with the packing sheet delivered from the spindle are picked up directly and fed in phase between the parallel and horizontal motorized conveyors of a tilting drum positioned inside which longitudinally, edgewise and parallel with each other, are folding devices which guide the product with the packing laterally and fold on the lateral faces of the product the first flaps with vertical folding, projecting laterally and anterior in the feed direction of the packing.

22 Claims, 7 Drawing Sheets

U.S. PATENT DOCUMENTS

| | | | | |
|---|---|---|---|---|
| 5,463,846 | A * | 11/1995 | Gambetti | 53/465 |
| 5,701,725 | A * | 12/1997 | Neri et al. | 53/466 |
| 6,067,780 | A | 5/2000 | Gentili et al. | |
| 6,474,041 | B1 * | 11/2002 | Gambetti | 53/141 |
| 6,640,522 | B2 * | 11/2003 | Antoniazzi et al. | 53/466 |
| 6,766,625 | B2 * | 7/2004 | Cinotti | 53/230 |
| 6,799,410 | B2 * | 10/2004 | Gamberini | 53/233 |
| 6,935,091 | B2 * | 8/2005 | Gamberini | 53/466 |
| 2001/0022061 | A1 * | 9/2001 | Resta | 53/228 |
| 2005/0016127 | A1 * | 1/2005 | Malini | 53/209 |
| 2005/0235613 | A1 * | 10/2005 | Malini | 53/556 |
| 2006/0185328 | A1 * | 8/2006 | Salicini et al. | 53/463 |
| 2007/0266676 | A1 * | 11/2007 | Biondi et al. | 53/234 |
| 2008/0134636 | A1 * | 6/2008 | Drenguis et al. | 53/234 |

FOREIGN PATENT DOCUMENTS

| | | | |
|---|---|---|---|
| EP | 1 227 040 | B2 | 12/2005 |
| GB | 2 228 914 | A | 9/1990 |

* cited by examiner

F1

METHOD AND MACHINE FOR PACKING GROUPS OF PRODUCTS ARRANGED IN ONE OR MORE LAYERS

The invention relates to a method and to a machine for packing groups of products arranged in one or more layers, e.g. reams of paper or hand towel rolls or toilet rolls. In particular, the method and the machine in question constitute an improvement in the construction and function of the method and machine described in the European patent application no. 02001691.1 dated 24 Jan. 2002, by the same applicant, designed to pack reams of paper, to which ample reference is made. This patent application provides for placing the ream of paper horizontally with the base thereof and feeding it horizontally through a horizontal spindle positioned in which transversally, edgewise and vertically, is the packing sheet which is parallel with the front end of the ream and which is retained above and below, at the horizontal sides, by pairs of feed belts. By means of lower conveyors and lateral conveyors with thrust projections, suitably motorized, the ream is fed through said horizontal spindle and delivered therefrom wrapped anteriorly and on the lower and upper faces by the packing sheet which, viewed laterally, is in the shape of a "U" rotated through ninety degrees and open on the posterior end in feed direction of the ream. The wrapping sheet is placed in front of said spindle with a relation suitable to wrap the upper face of the ream, without projecting therefrom and to instead wrap the lower face of said ream and project posteriorly from said face with a horizontal portion of adequate length. Upon delivery from the folding spindle, the ream with the wrapping sheet is supported and fed at the correct speed, by a pair of horizontal conveyors, reciprocally placed one over the other and motorized, laterally to which folding devices operate edgewise to fold, on the lateral faces of the ream, the flaps with vertical fold, anterior in feed direction and projecting laterally of the wrapping sheet and from said pair of conveyors the ream with the wrapping sheet is fed between the horizontal conveyors, placed one over the other and motorized at the correct speed, of a tilting drum, with horizontal axis, provided internally with fixed cross bars against which the anterior end of the partially wound ream stops in contact. After the ream has been inserted, the drum rotates through 180° about its axis crosswise to the feed direction of said ream and in the direction so that the posterior face of said ream, which was not wrapped previously, is placed anteriorly to the future feed direction of the packed product and it too is wrapped by the packing sheet which still projects under said face with a portion of the correct length. The internal and fixed cross bars of the tilting device, after rotation thereof are located on the lower end of the ream. The parallel conveyors of the tilting device are reactivated to eject the ream and transfer it in phase between a subsequent pair of motorized conveyors, horizontal and placed reciprocally one over the other, between which tubular wrapping of the ream in the packing sheet is completed and it is fastened with a transverse line of glue applied thereto, while lateral folding devices are provided which first fold on the sides of the ream the flaps with vertical folding, anterior in feed direction, and then other folding devices fold the lateral flaps with horizontal folding, first the lower one followed by the upper one, placing them over the flaps folded previously and therebetween, while specific means reciprocally fasten these flaps with glue. After ejection of the ream with the packing sheet, the empty tilting device rotates through 180° to return to the initial position to receive a subsequent ream with packing sheet.

The invention proposes the use of a machine and process of this type to pack parallelepiped shaped groups of products of different format, with packing sheets, with all the adjustments required by the variation in format, not contemplated in the patent application cited in the preamble and proposes improvements to a machine of this type to eliminate the pair of horizontal conveyors that collect the product and packing sheet upon delivery from the first wrapping spindle, with folding devices that acted on the first lateral flaps of the wrapping with vertical folding and anterior in feed direction. According to the invention, the group of products delivered from the first wrapping spindle is fed directly between the parallel conveyors of the tilting device, inside which the lateral folding devices of the first vertical flaps of the wrapping sheet are located. In the next step the tilting device rotates through 180° about its axis and remains in this position to receive a subsequent group of products with relative packing sheet and to simultaneously eject the previous group of products with relative wrapping sheet, to eliminate the lengthy idle times of the prior art solution, according to which the tilting device first had to unload the ream from the previous cycle and then rotate empty through 180° to return to the condition required to receive the subsequent ream.

These and other important features of the new machine and of the respective operating process, will be more apparent from the following description of a preferred embodiment and implementation thereof, illustrated purely by way of a non-limiting example, in the figures of the seven accompanying drawings, wherein.

Figures 1, 2, 2A, 3, 3A:
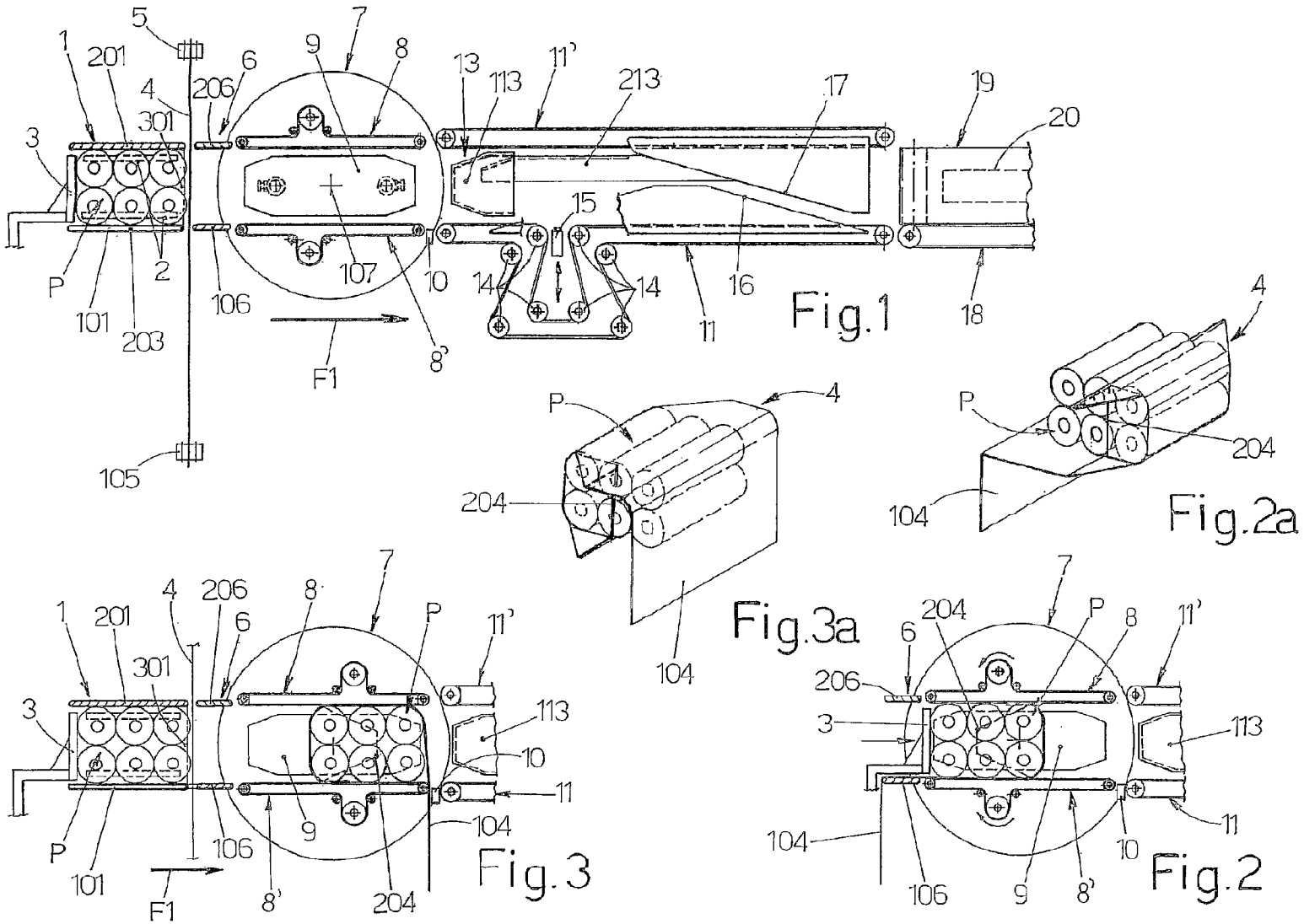
FIG. 1 is a schematic side view of the machine in the condition at the start of the cycle.
FIGS. 2, 3, 4 and 5 show, schematically and in side elevation, subsequent operating steps of the machine according to FIG. 1.
Figure 4:
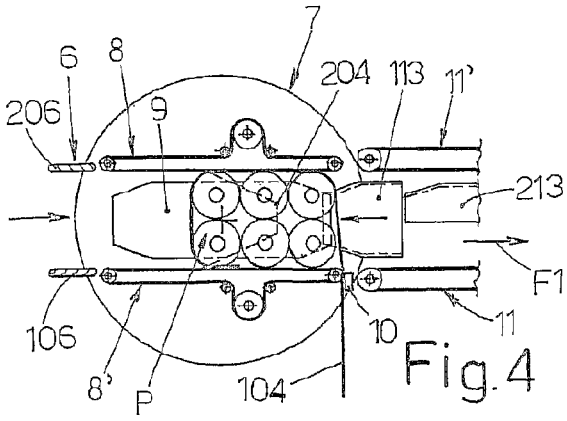
Figure 5:
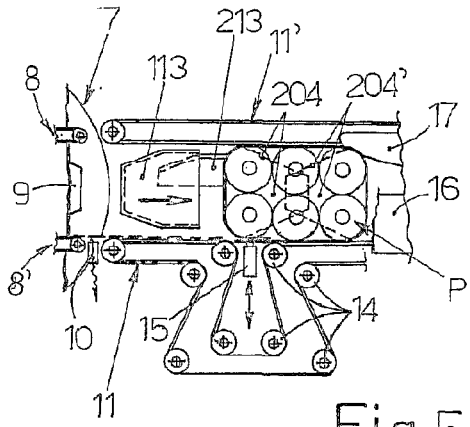
Figure 4A:
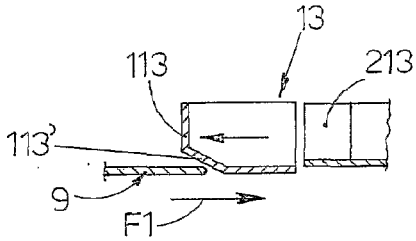
Figure 5A:
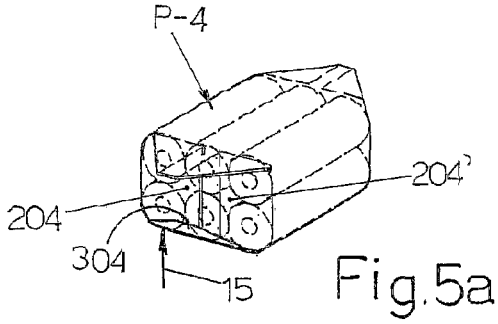
Figure 5B:
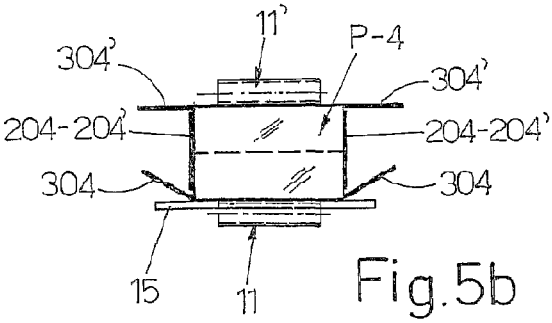

FIG. 4*a* is a schematic top view and with parts in section of one of the moving lateral folding devices that act downstream of the tilting drum, shown in the active operating step;

FIGS. 2*a*, 3*a* and 5*a* illustrate a perspective view of the same number of subsequent steps of the cycle to form the packing, as illustrated in the respective machine steps in FIGS. 2, 3 and 5;

FIG. 5*b* is an elevated view from the anterior end of the packing in the crosswise sealing step, as shown in FIGS. 5 and 5*a;*

Figure 6:
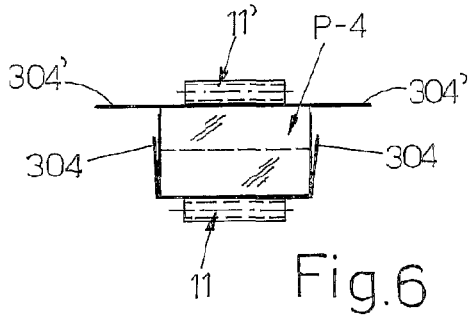
Figure 7:
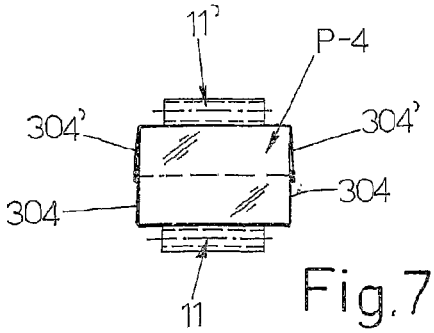
Figure 8:
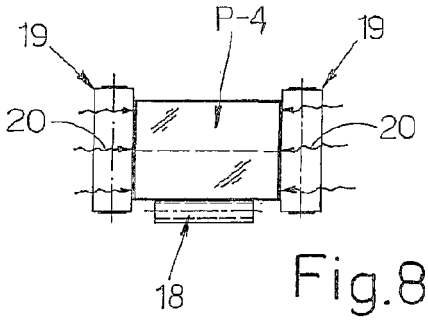
Figure 9:
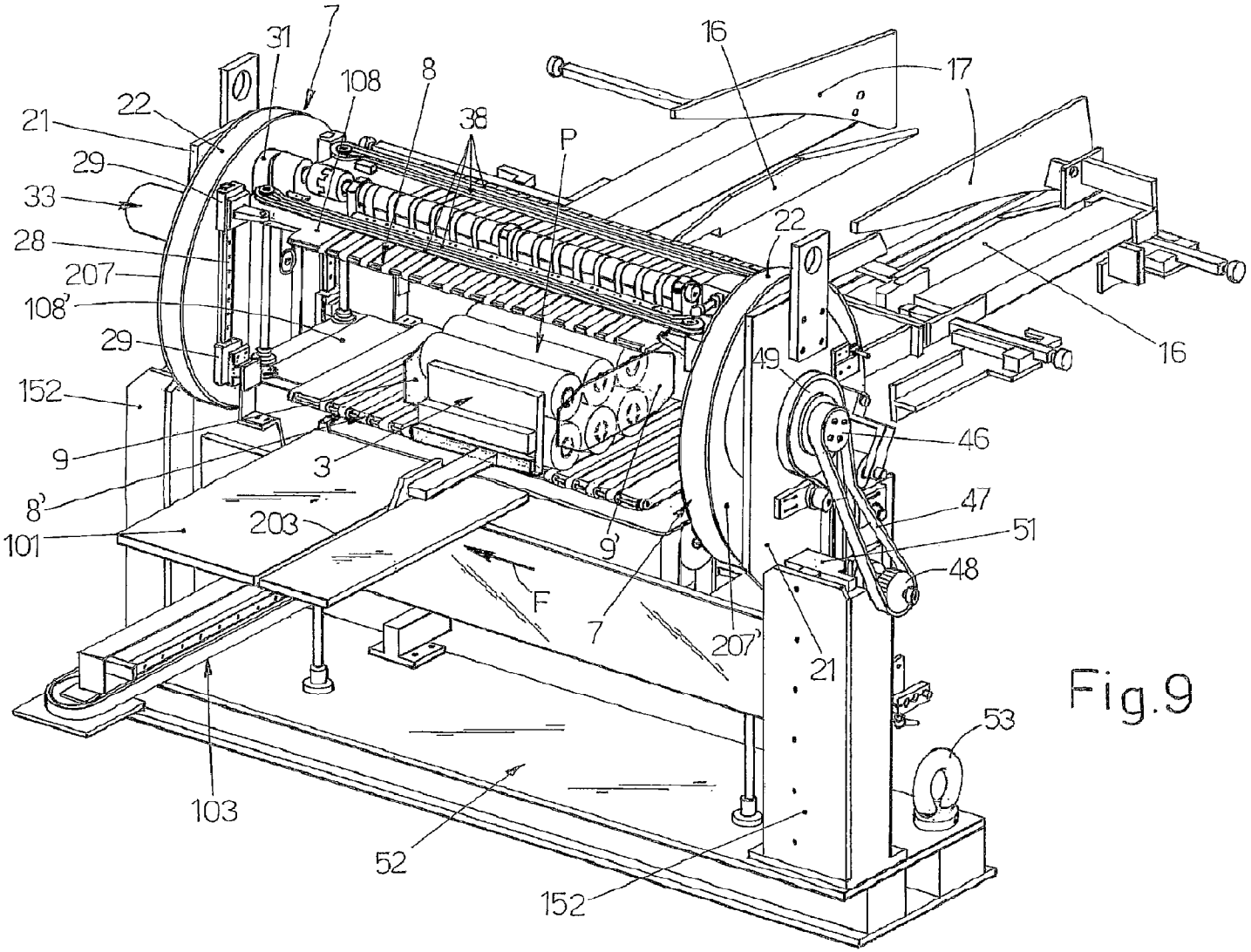
Figure 10:
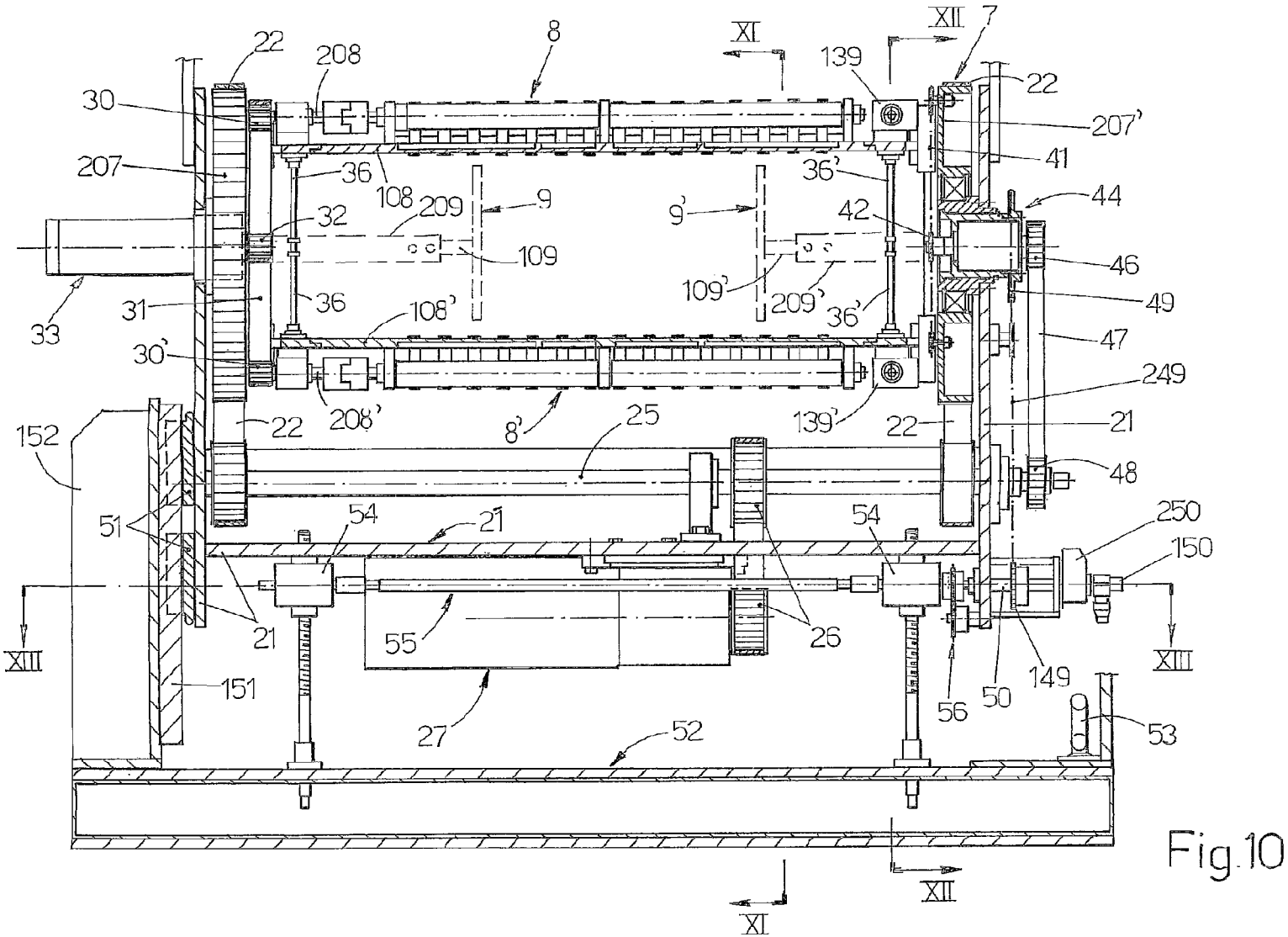
Figure 11:
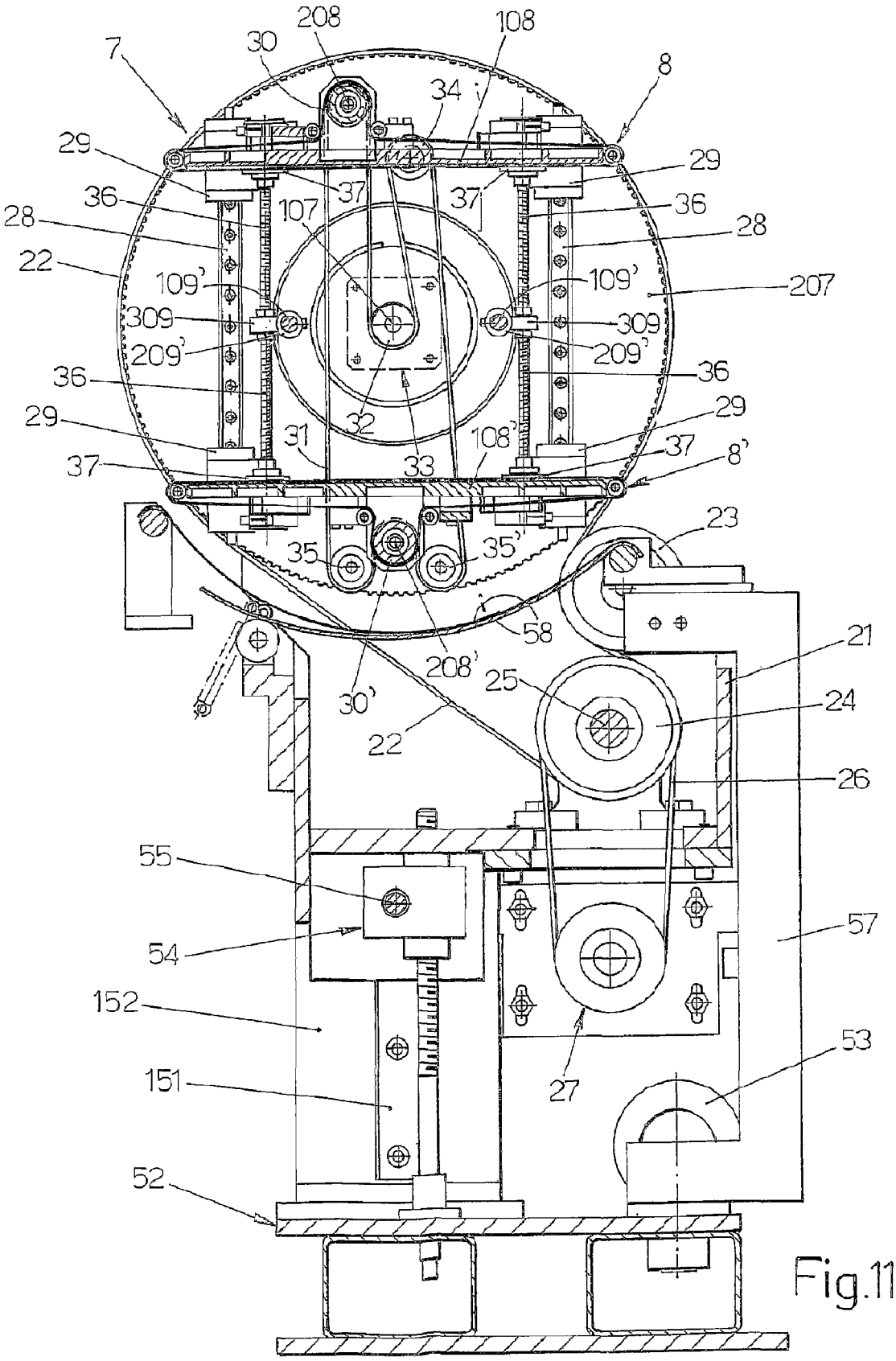
Figure 12:
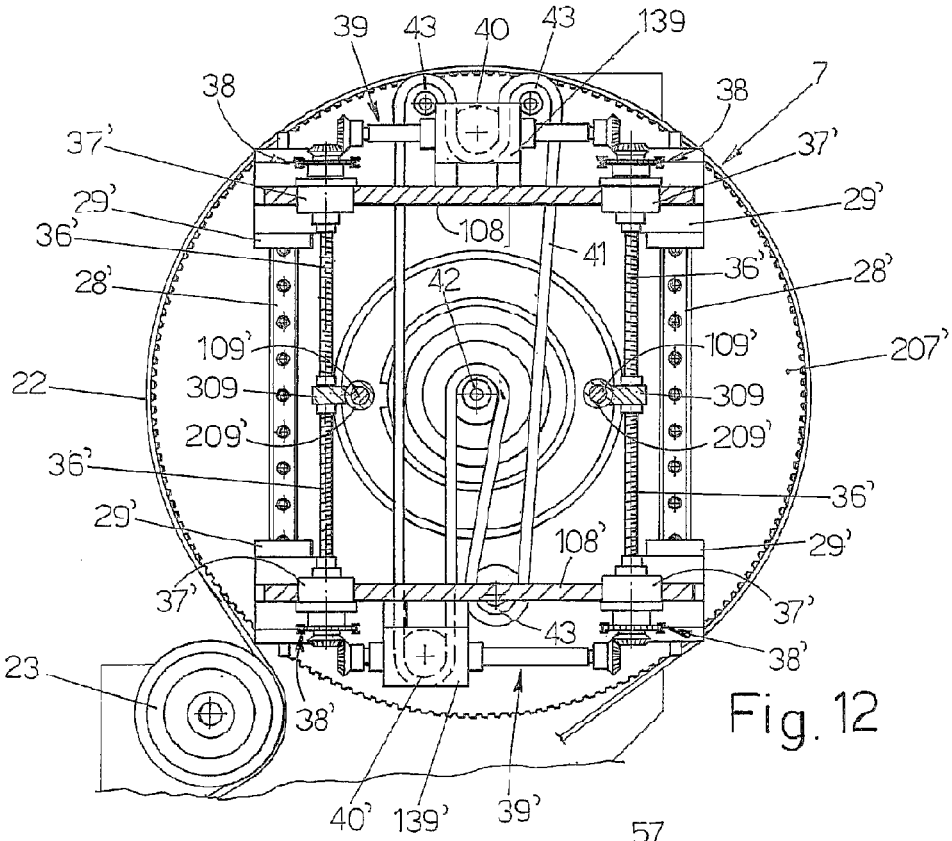
Figure 13:
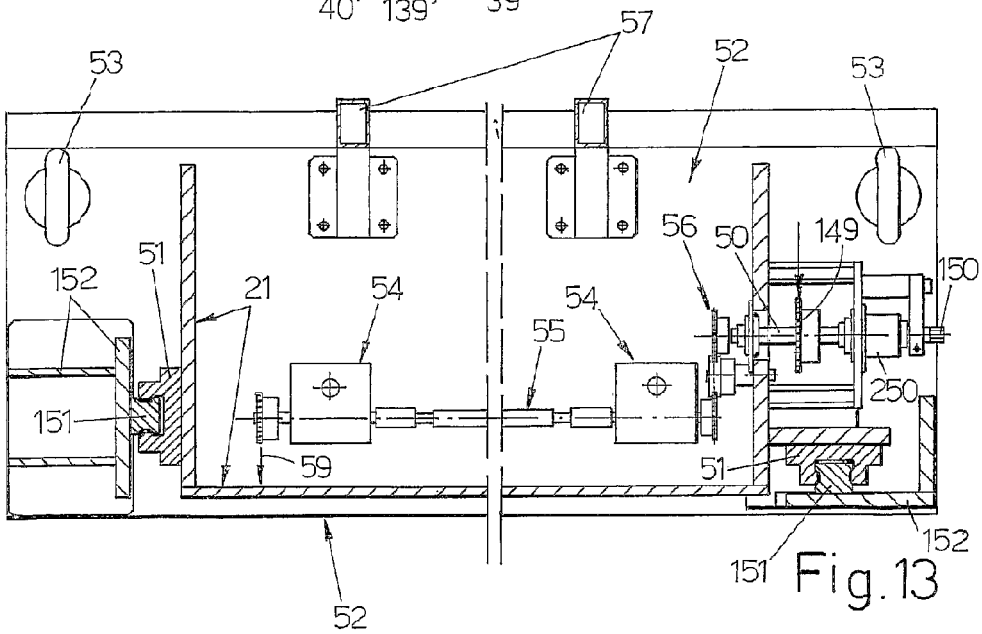
Figure 15:
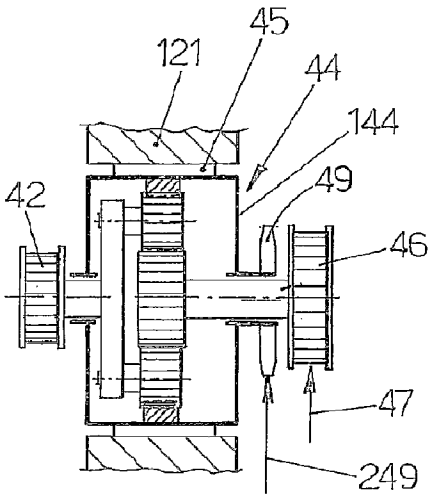
Figure 14:
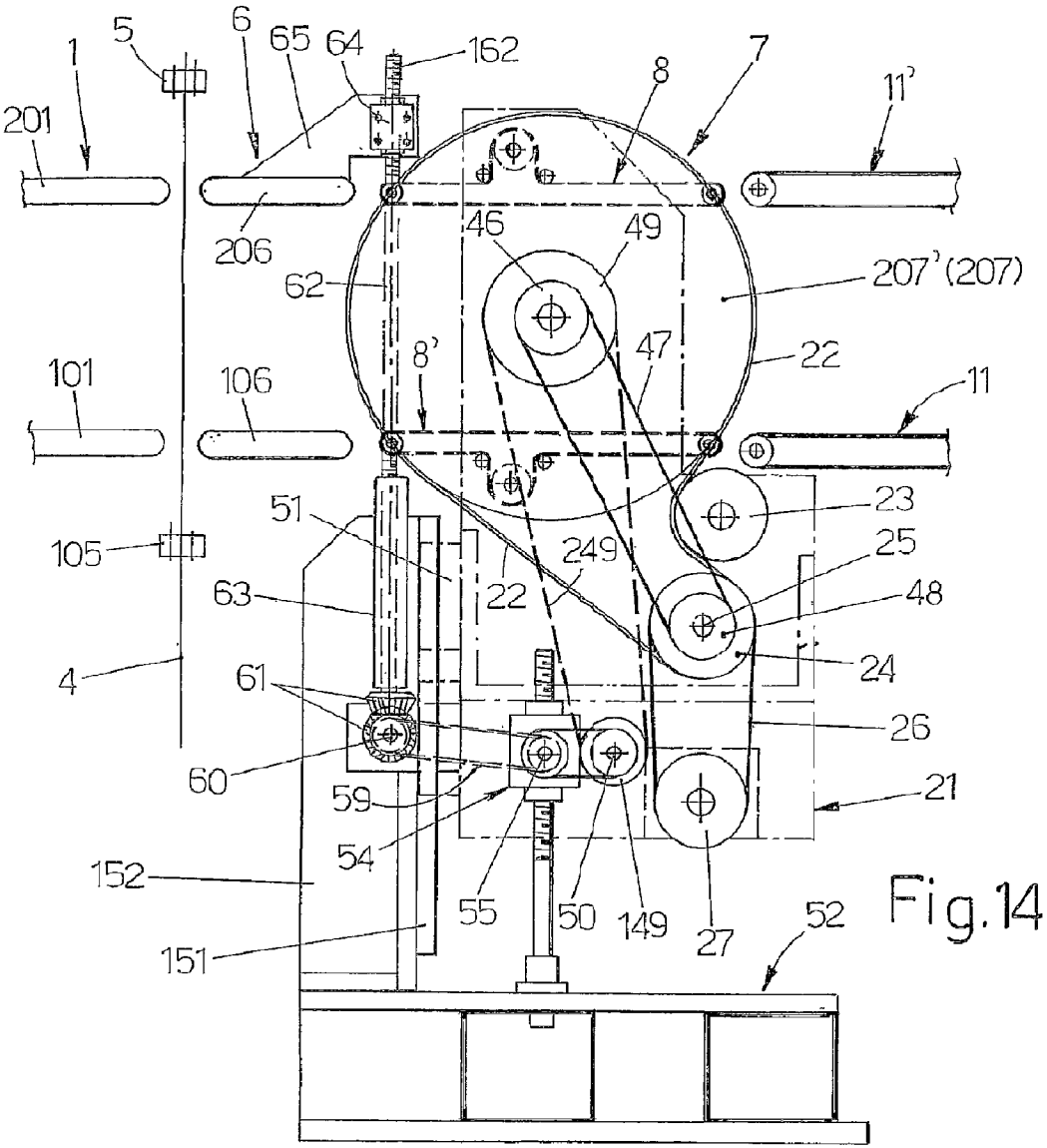

FIGS. 6, 7 and 8 illustrate the packing in elevation from the anterior end in the last steps to close and fasten the lateral flaps;

FIG. 9 is a perspective view of the tilting drum shown from the inlet end of the product to be packed;

FIG. 10 illustrates the tilting drum viewed in elevation from the inlet end of the product and with some parts in section;

FIGS. 11, 12 and 13 illustrate the same number of details of the tilting drum sectioned respectively according to the lines XI-XI, XII-XII and XIII-XIII in FIG. 10;

FIG. 14 illustrates the tilting drum in a side elevation and with the means to adjust the height of the axis of rotation thereof when the format of the product to be packed varies;

FIG. 15 schematically illustrates an epicyclic reduction gear, of the type used in the adjustment means according to FIGS. 12 and 14.

In the following description, embodiment and operation of the machine for packing groups of hand towel rolls is detailed, without however excluding use of the same machine to pack groups of other products, as will be better specified below.

From FIGS. 1 and 9, it can be seen that the machine comprises a feed unit 1, cyclically composed in which is a prismatic group with rectangular base of rolls P of paper, arranged in one or more layers placed on top of one another, and this feed unit is provided with an lower wall 101 which remains fixed when the format of the group of rolls P varies and is provided with an upper wall 201, which must instead be adjusted in the position in height when said format varies. The letter F in FIG. 9 indicates a possible feed direction of the rolls of paper which, in the example herein (see also FIG. 1), have their hollow core oriented longitudinally in the direction along which they are fed by the thrust crossbars 2 of feed conveyors, known and not illustrated. At the opposite end to the one involved by the crossbars 2, the feed unit 1 is closed by a vertical retaining wall 301, the position of which is adjusted when the format of products P varies. Located on one side of the feed unit 1 is a pusher 3 connected to translation means 103 (FIG. 9) positioned under the plate 101 which for this purpose has a slot 203 suitable for the projection that connects said translation means to the pusher 3 to pass through when it is activated to unload the group of rolls P from the feed unit 1 and to transfer it towards subsequent means, with a movement F1 in the direction orthogonal to the feed direction F of the group of rolls in said feed unit. The packing sheet 4 (FIG. 1), which in the example in question is a heat-sealable plastic material, is positioned crosswise and with a suitable vertical arrangement on the opposite side of the feed unit 1 to the one engaged by the aforesaid pusher 3, and said sheet is retained by the upper flap and by the lower flap by pairs of parallel and motorized belts 5, 105, which are part of a feed unit that takes the sheets 4 from a continuous film unwound from a reel, said unit being known and not illustrated in detail herein. On the same side of the feed unit 1 engaged by the packing sheet 4, placed laterally to said sheet is a first wrapping spindle 6, comprising a lower horizontal wall 106 and an upper horizontal wall 206 coplanar respectively with the walls 101 and 201 of the feed unit upstream 1, and which like these are respectively fixed, the lower one, and movable, the upper one, when the format of the product P to be packed varies. Located on the end of the walls 106 and 206 of the folding spindle 6 that is opposite the one involved by the packing sheet 4, in coplanar alignment, placed one over the other and motorized, are the horizontal conveyors 8, 8' of the tilting drum 7, which can be controlled to rotate through 180° about its axis 107, which is horizontal and orthogonal to the longitudinal direction of said conveyors 8, 8', located longitudinally between which, edgewise and with symmetrical arrangement, are lateral folding devices 9, 9' supported by said drum and suitable to operate actively with one or with the other of the ends thereof (see below). When the format of the product to be packed varies, means are provided to adjust the reciprocal distance between the lateral folding devices 9, 9' and other means to adjust the reciprocal distance of the conveyors 8, 8', while the entire tilting drum 7 is adjusted in the position in height, so that these conveyors are aligned with the walls 101, 106 and 201, 206 of the parts 1 and 6 mentioned previously. The means as described above operate in the following way. After a group of rolls P has been formed in the feed unit 1 (hereinafter the parallelepiped shaped group of rolls will simply be referred to with the term "product"), said product P is pushed by the pusher 3 towards the means downstream 6 and 7, while the conveyors 8, 8' of the drum 7 are activated to run with the inner branches at the same speed and in the same feed direction as the pusher 3. The product P delivered from the feed unit 1 by the pusher 3, frontally touches the wrapping sheet 4, which is held in correct phase with a limited friction by the conveyor belts 5, 105 and with this sheet the product first passes between the walls 106 and 206 of the spindle 6 to then be positioned between the conveyors 8, 8' of the drum 7. Specific guide means, not illustrated, support and correctly accompany the sheet released by the belts 5, 105, to maintain it suitably stretched and prevent unwanted creases from forming when said sheet passes through the spindle 6. Drawn by the product P and by the conveyors 8. 8', the wrapping sheet 4 is released from the belts 5, 5' and when the product reaches said conveyors 8, 8' of the drum 7, the sheet 4 wraps the product P as shown in FIG. 2, in part on the upper face, on the anterior end in feed direction and on the lower face, substantially in the shape of a "U" rotated through ninety degrees and open in the direction of the pusher 3. On the side of the belts 5, 105, the wrapping sheet 4 is placed in relation to the forming spindle 6, so that in the step in FIG. 2 said sheet projects from the lower face of the product P with a portion 104 of the correct length (see below). Simultaneously, as illustrated in FIG. 2*a*, the sheet must also project with portions of adequate and identical width from the sides of the product P and in the step in FIG. 2 the vertical folding flaps 204 of these projecting parts of the wrapping, cooperating with the folding devices 9, 9' of the drum 7, are folded on the lateral faces of the product P. The inner surfaces of the walls 101 and 201 of the feed unit 1 and of the walls 106, 206 of the folding spindle 6 that operate in contact with the product P and with the wrapping sheet 4, for construction and reciprocal vertical positioning, are such as to have a limited friction coefficient which is nonetheless adequate against said parts P and 4. The conveyor belts 8, 8' of the drum 7 are instead such as to have sufficient sliding friction against the wrapping sheet 4, so as to have a positive action thereon.

After insertion of the product and of the wrapping sheet between the conveyors of the drum 7, as already mentioned with reference to FIG. 2, said conveyors 8, 8' stop and the pusher 3 reverses its movement to return to the position it has at the start of the cycle as shown in FIG. 3, the drum 7 is rotated through 180° about its axis 107, so that at the end of said rotation, through the action of specific guide and longitudinal tensioning means (see below), said wrapping portion 104 wraps the new anterior face in feed direction of the product P and again projects by the correct portion from the lower face of said product, as shown in the perspective view in FIG. 3*a*. This lower and projecting portion 104 of the wrapping sheet cooperates with a fixed suction cross bar 10 which maintains it suitably stretched, both during transition from the step in FIG. 2 to the step in FIG. 3, and during the step illustrated below.

Downstream of and in coplanar alignment with the conveyors 8, 8' of the tilting drum 7 (FIG. 1) there is provided a pair of horizontal belt conveyors 11, 11', placed one over the other in parallel and motorized for control by means, not illustrated, that make them run with the inner branches away from the drum 7 and at the same speed of movement as the conveyors 8, 8' of said tilting drum 7 (see below). In the space between the conveyors 11 and 11', laterally thereto and at the level of the drum 7, there are provided longitudinally folding means 13 comprising a part 113 closer to the drum, guided and moving horizontally and a subsequent fixed posterior part 213. After the step in FIG. 3, as illustrated schematically in FIGS. 4 and 4*a*, the moving anterior part 113 of the lateral folding devices 13 is moved, by suitable means, towards the end of the lateral folding devices 9, 9' of the drum 7, and positioned on the outside thereof with a tapered portion 113'. In the subsequent step the conveyors 8, 8' of the drum 7 are operated to eject the product P with the wrapping sheet and simultaneously the conveyors 11, 11' are also activated to receive and remove without slip the pack ejected from the drum 7. In this step a new product P with relative wrapping sheet is fed between the conveyors 8, 8' by the pusher 3, as already stated with reference to FIG. 2, so that the tilting drum 7 operates substantially without idle times, as is instead the case in the prior art. In this case, the tilting drum 7 rotates cyclically through 180° always in the same counter-clockwise direction looking at the accompanying drawings. In this same step, the suction bar 10 maintains the projecting portion 104 of the wrapping sheet stretched longitudinally, which during transfer of the product between the conveyors 11, 11' is stretched under said product fed between said conveyors which stop (see FIG. 5) when the lower part of said product that is involved by the two overlapping parts of the wrapping sheet reaches the level of an intermediate and crosswise gap in the lower conveyor belt 11, defined by driving said belt around a plurality of parallel rollers 14 and placed crosswise in said gap is a heat-sealing bar 15, which is raised and then lowered by suitable means to reciprocally seal the two overlapping parts of the wrapping sheet, using as counter-roller one of the rolls of paper forming the product P. During transfer from the drum 7 to the conveyors 11, 11', the lateral flaps with vertical folding 204' of the wrapping sheet are folded on the lateral faces of the product P by the folding device 13 and, as illustrated in FIGS. 5*a* and 5*b*, when the product reaches the level of the sealing bar 15, the lower lateral flaps with horizontal folding 304 have been partly lifted by the folding devices 16 positioned laterally to the conveyors 11, 11', as shown in FIG. 1, so that said flaps do not interfere with the sealing bar 15. In the next step, after the sealing bar 15 has been lowered and the seal performed has been suitably cooled, the packed product is once again moved forward by the conveyors 11, 11', while the lateral folding devices 16 and subsequent folding devices 17 fold, on the lateral faces of the product, first said flaps 304 as illustrated in FIG. 6 and then the corresponding upper flaps 304' also with horizontal folding, which are placed reciprocally over each other and over the flaps with vertical folding 204, 204', as illustrated in FIG. 7. Finally, FIGS. 1 and 8 show that the packed product is delivered from the conveyors 11, 11' and is picked up and moved away without slip by a lower horizontal conveyor 18 and by a pair of parallel and vertical conveyors 19, all motorized at the correct speed and a heating source 20 operates between said vertical conveyors to perform heat sealing and reciprocal fastening of said lateral and overlapping flaps of the packing sheet, with a technique known in the art which will not be explained in depth herein and which includes adjusting means to adjust all the means operating downstream of the tilting drum 7 to operate on products of different format.

FIGS. 9, 10 and 11 show that the tilting drum 7 has side panels formed by a pair of toothed wheels 207, 207' of large diameter and identical, supported rotatingly by the external uprights of a U-shaped supporting structure 21, better explained below and which are motorized in rigid phase by connection by means of toothed belts 22, with tensioning devices 23, to the toothed pulleys of the same diameter 24 of a parallel synchronization shaft 25 which with the ends is supported rotatingly by said frame 21 and which with a suitable positive drive transmission 26 (FIGS. 10, 11) is connected to a motor 27, also fastened to the frame 21 and preferably of the type with electronic control of speeds and phase, e.g. a brushless motor. Fastened on the inner faces of said side panels 207, 207' with symmetrical arrangement in relation to the axis of rotation 107 of the drum 7, are pairs of rectilinear precision guides 28, 28', sliding on which are recirculating ball guides 29, 29' integral with the ends of the flat frame 108, 108' which supports the pulleys and belts placed side by side with and parallel to each other forming the conveyors 8, 8' of the drum 7 and means are provided (see below) to vary, in a self-centering manner, the distance between said conveyors 8, 8' when the format of the product to be packed varies. The belts of the conveyors 8, 8' are also driven around toothed pulleys keyed onto shafts 208, 208' external to said flat frames 108, 108', supported rotatingly thereby and said shafts support, keyed onto a same end, respective identical toothed pulleys 30, 30' involved respectively by the inner toothing and by the outer toothing of a belt 31 with double toothing which kinematically connects said pulleys to a pulley 32 positioned coaxially on the inner face of the adjacent side panel 207 of the drum and keyed onto the shaft of an electric motor 33 with electronic control of speed and phase, flanged with the body thereof onto the outer face of the upright of the structure 21 that rotatingly supports said side panel 207. At the level of the toothed pulleys 30, 30', the belt 31 is made to follow a sinuous path to be driven around other toothed pulleys 34 and 35, 35' supported idle by the inner face of said side panel 207. By varying, in a self-centering manner, the distance between the conveyors 8, 8' of the drum 7 with the means specified below, it appears evident that the double branches of the belt 31 driven around the pulleys 30, 30' modify their length in opposite ways, as while one double branch is shortened, the other double branch is lengthened by a same distance, always maintaining the belt 31 correctly stretched.

With reference to FIGS. 10, 11 and 12, it can be seen that the lateral folding devices 9, 9', which operate inside the tilting drum 7, are provided on the outer face with pairs of rods 109, 109' that slide guided and manually adjustable inside tubes 209, 209', flanged with the other end on the inner face of the side panels 207, 207' of the drum 7. These tubes are provided at the level of the fastening flange, with outer projections 309 (FIG. 12) which rotatingly support the intermediate part of corresponding pairs of right and left screws 36, 36', parallel to the guides 28, 28' and the ends of which cooperate with casings 37, 37' provided with corresponding screw nuts, not shown, and integral with the frames 108, 108' of the conveyors 8, 8'. By means of positive kinematic connections 38, 38', e.g. of the type with pinions and with chains positioned longitudinally on the frames 108, 108', the screw nuts of the screws 36 are connected in phase with those of the screws 36', while at the level of the side panel 207' of the drum 7, the screw nuts of the screws 36' are connected to each other by means of a pair of positive drives 39, 39', which comprise conical couplings and gearboxes 139, 139', which are integral with the frames 108, 108' and are each provided with an input axis parallel to the axis 107 of the drum 7, facing the side panel 207', and keyed onto which are identical toothed pulleys 40, 40' driven around which respectively with its outer toothing and with its inner toothing is a belt 41 with double toothing, which derives motion from a control toothed pulley 42 positioned on the axis 107 of the drum 7. By means of idle pulleys 43 supported by the side panel 207' of said drum 7, the toothed belt 41 is obliged to take a sinuous path, in which it involves said toothed pulleys 40, 40', with double branches, all so that when the self-centering variation of the reciprocal distance between the frames 108, 108' of the conveyors 8, 8' occurs, said double branches of the belt 41 modify their length in a simultaneous and opposite way, maintaining the tension of said toothed belt 41 unchanged.

From FIG. 12 it appears evident that when the pulley 42 is rotated in one direction or the other, depending on whether the distance between the conveyors 8, 8' of the drum 7 is to be increased or decreased, through the toothed belt 41 rotation is transmitted to the pulleys 40, 40' and through the kinematic mechanisms 39, 39' it is transmitted to the screw nuts of the casings 37 and also to those of the casings 37' to which they are connected with the drives 38, 38' and with rotation of said screw nuts on the fixed screws 36, 36', the frames 108, 108' move reciprocally away from or towards each other by the required distance and with self-centering movement.

FIGS. 10 to 15 show that the toothed pulley 42 is keyed onto the output shaft of an epicyclic reduction gear 44 which with its body 144 is mounted rotatingly on the hub 121 of the frame 21 which rotatingly supports with bearings the side panel 207', by means of bushings 45 or other suitable means. Keyed onto the input shaft of the reduction gear 44 is a toothed pulley 46 which through a toothed belt 47 is connected to a corresponding toothed pulley 48 keyed onto the shaft 25, which synchronizes rotation of the two side panels 207, 207' of the drum 7 (FIG. 14).

On the side of the input pulley 46 there is provided a pinion or other means 49 which through chains 249 is connected to a corresponding pinion 149 (FIG. 14) keyed onto an adjustment shaft 50 mounted rotatingly on the frame 21 and which can be made to rotate with a manual control or with a servo-control. Adjustment of the distance between the conveyors 8, 8' of the drum 7 is implemented through the shaft 50 and usually with the machine stopped. With rotation of the shaft 50 and of the pinion 49, as the pulley 46 remains still (FIG. 15), the body 144 of the reduction gear 44 rotates and the output shaft with the pulley 42 rotates proportionally to the input rotation imparted to the pinion 49, determining the required adjustment of the reciprocal distance of the conveyors 8, 8'.

To maintain the distance between these conveyors 8, 8' unchanged when the drum 7 rotates cyclically through 180°, as in this step the pinion 49 and the body of the reduction gear 44 are stopped, said rotation of the drum is imparted with the belt 47 and the pulley 46, to the primary shaft of the reduction gear 44, so as to obtain the required effects.

From FIG. 14 it appears evident that by varying the reciprocal distance between the conveyors 8, 8' of the tilting drum, the distance between the lower one of said conveyors varies in relation to the lower component 106 of the folding spindle 6 and of the conveyor 11 downstream, and therefore it is necessary to make a corresponding adjustment of the position in height of the axis of rotation 107 of said drum 7. From FIGS. 9, 10, 11, 13 and 14 it can be seen that the frame 21, which rotatingly supports the drum 7, is provided with at least one pair of vertical slides 51, with recirculating balls, positioned on planes orthogonal to each other and sliding on corresponding guides 151 supported by the uprights 152 of a solid bed structure 52 provided with eye-bolts 53 for handling of the entire apparatus with the tilting device. With a lower cross-member thereof, the frame 21 is connected to the bed 52 by means of a pair of vertical mechanical jacks 54 with screw-screw nut, synchronized by a drive transmission 55 with screw-helical gear, which by means of a positive drive 56, e.g. with pinions and chain (FIGS. 10, 13, 14) is connected kinematically to the shaft 50 with its drive 150 for manual operation or with suitable means and with a register 250 that helps the operator in the adjustment to be made. By acting on the shaft 50 to vary the relative distance of the conveyors 8, 8', the jacks 54 are simultaneously activated to modify the position in height of the axis of the drum 7 as specified above.

From FIGS. 13 and 14 it appears that the drive transmission 55 that synchronizes the jacks 54 is connected with a positive drive transmission 59 to a synchronization shaft 60 mounted rotatingly on a moving frame 21 and which through conical couplings 61 rotates a pair of vertical shafts 62 supported rotatingly by bushings 63 also integral with the frame 21, so as to move vertically therewith. The shafts 62 are provided with identical upper threads 162 which cooperate with screw nuts 64 integral with lateral supporting brackets 65 of the upper plate 206 of the first folding spindle 6, so that when the distance between the conveyors 8, 8' of the drum 7 varies, the distance of the plate 206 from the lower fixed plate 106 is also automatically varied. Between the drive 59 and the shaft 60 a disengaging device, not shown, can be provided, which can be operated to release said shaft and prepare it for fine and selective rotation, with means not indicated and suitable for the purpose.

In FIGS. 11 and 13, the numeral 57 indicates supports integral with the bed 52, which support the first means 11, 11' located downstream of the tilting drum 7 and which support under said drum, one of the curved guides 58 that correctly accompany the portion 104 of the packing sheet during cyclic rotation of the tilting device 7, as stated with reference to FIGS. 2 and 3.

It is understood that the description refers to a preferred embodiment of the invention, to which numerous variants and modifications can be made, above all in relation to the type of product to be packed. If the machine is intended for the treatment of products which, due to their nature and/or the arrangement of their components, cannot be compressed to any great degree, the conveyors 8, 8' of the drum 7 can use belts that are suitably elastic-yielding or that can be mounted on specific springing means. If need be, the plates 106, 206 of the first folding spindle 6, can be replaced by suitable idle or motorized conveyors.

This and all those modifications, moreover intuitable to those skilled in the art, fall within the scope of the invention, as described, illustrated and as claimed hereunder. In the claims, the references indicated in brackets are purely indicative and do not limit the scope of protection of said claims.

The invention claimed is:

1. A method for packing groups of products or products of prismatic shape having a rectangular or square base, comprising moving said groups of products or said products from a feed or grouping unit towards a first folding spindle so as to be delivered therefrom wrapped substantially in a shape of a "U" rotated through 90° and open at back, by a packing sheet which is present in front of said spindle with vertical positioning, wherein the groups or the products along with the packing sheet are delivered from said spindle and picked up directly and fed in phase between parallel and horizontal motorized conveyors of a tilting drum, wherein folding devices are arranged inside said tilting drum longitudinally, edgewise and parallel with each other; said folding devices laterally guiding the groups of products or the products with the packing sheet and folding on lateral faces of said groups or said products first flaps of said packing sheet with vertical folding, projecting laterally and anterior in feed direction, while said groups or said products are advanced along said tilting drum by said conveyors; and wherein maintaining as a fixed reference an ideal horizontal plane on which said groups or said products run during packing so as to receive and operate on products of different formats and including varying, in a self-centering manner, spacing between the conveyors of the tilting drum and to simultaneously adjust positioning in height of an axis of rotation of said tilting drum, with lowering or lifting of the positioning being respective of a decrease or increase of the format.

2. The method as claimed in claim 1, wherein after folding of said first flaps, said conveyors are stopped, said tilting drum is controllably rotated cyclically through 180°, in one direction while loaded with a partially packed product, and after each rotation of said tilting drum about an axis orthogonal to the feed direction of the groups or the products, the conveyors of said tilting drum are reactivated to eject the groups or the products with the packing sheet towards means that complete folding and fastening of the first flaps of said packing sheet; and concurrently unloading a new product with relative packing sheet directly from said first folding spindle and feeding said new product between the conveyors of said tilting drum.

3. A machine for packing the groups of products or the products, for implementation of the method according to claim 1, comprising:

a feed unit in which a group of products or a product is introduced, which is then fed horizontally in a pre-established direction for a packing cycle;

a first folding spindle positioned laterally to said feed unit and aligned therewith according to said direction;

means for cyclically positioning the packing sheet with vertical arrangement between said feed unit and said spindle, dimensions and placing of said sheet being correlated to a format of the group or the product to be packed;

a motorized pusher which, in correct phase and with alternate movements, pushes the group or the product to be delivered from said feed unit and fed through said folding spindle drawing therewith said packing sheet which in correct phase is released by a relative feed means and wraps the group or the product in a "U" shape rotated through 90° and being open at back;

a tilting drum which with a pair of motorized conveyors receives the group or the product with the packing sheet delivered from said folding spindle and pushed by said pusher, means being provided to cyclically rotate said tilting drum by 180° in one direction around the axis of rotation;

downstream of said tilting drum, means for receiving the group or the product and the packing sheet cyclically unloaded from the tilting drum and which completes folding of the first flaps of the packing sheet and fastens the first flaps;

wherein said tilting drum includes folding devices arranged longitudinally and parallel to each other between said conveyors, said folding devices structured to laterally guide the group or the product with the packing sheet and fold on the lateral faces of said group or said product the first flaps of said packing sheet with vertical folding, projecting laterally and anterior in the feed direction;

said conveyors and said tilting drum being arranged and controlled such that, following each rotation of said tilting drum said conveyors are reactivated to eject previously fed products and the packing sheet and to introduce a new group or product with the packing sheet coming from said first folding spindle into said tilting drum.

4. The machine as claimed in claim 3, wherein the conveyors of the tilting drum include elastic-yielding belts and/or are mounted on spring means.

5. The machine as claimed in claim 3, wherein the feed unit, in which the group of products placed in one or more layers is formed, comprises a lower wall which remains fixed, and at least one upper wall which is adjusted in height to accommodate varying formats of said group of products, and when said products acted upon are rolls of paper, an axis of a core of said rolls is positioned horizontally or vertically and parallel to the packing sheet in an original vertical position thereof.

6. The machine as claimed in claim 3, wherein a lower plate of the feed unit in which the group of products to be packed is arranged, includes a longitudinal slot passed through by a projection that connects the pusher to a relative translation means positioned under said plate and parallel to said slot.

7. The machine as claimed in claim 3, wherein means that in correct phase position the packing sheet between the feed unit and the first folding spindle comprising pairs of parallel and motorized belts, and additional means to take said packing sheet from a continuous strip unwound from a reel comprising guide means to support and maintain said packing sheet stretched when in correct phase and released by said belts and drawn by the product through said first folding spindle.

8. A machine for packing groups of products or products of prismatic shape having a rectangular or square base, for implementation of a method for packing the groups of products or the products comprising moving said groups of products or said products from a feed or grouping unit towards a first folding spindle so as to be delivered therefrom wrapped substantially in a shape of a "U" rotated through 90° and open at back, by a packing sheet which is present in front of said spindle with vertical positioning, wherein the groups or the products along with the packing sheet are delivered from said spindle and picked up directly and fed in phase between parallel and horizontal motorized conveyors of a tilting drum, wherein folding devices are arranged inside said tilting drum longitudinally, edgewise and parallel with each other; said folding devices laterally guiding the groups of products or the products with the packing sheet and folding on lateral faces of said groups or said products first flaps of said packing sheet with vertical folding, projecting laterally and anterior in feed direction, while said groups or said products are advanced along said tilting drum by said conveyors; wherein said machine comprises:

a feed unit in which a group of products or a product is introduced, which is then fed horizontally in a pre-established direction for a packing cycle;

a first folding spindle positioned laterally to said feed unit and aligned therewith according to said direction;

means for cyclically positioning the packing sheet with vertical arrangement between said feed unit and said spindle, dimensions and placing of said sheet being correlated to a format of the group or the product to be packed;

a motorized pusher which, in correct phase and with alternate movements, pushes the group or the product to be delivered from said feed unit and fed through said folding spindle drawing therewith said packing sheet which in correct phase is released by a relative feed means and wraps the group or the product in a "U" shape rotated through 90° and being open at back;

a tilting drum which with a pair of motorized conveyors receives the group or the product with the packing sheet delivered from said folding spindle and pushed by said pusher, means being provided to cyclically rotate said tilting drum by 180° in one direction around the axis of rotation;

downstream of said tilting drum, means for receiving the group or the product and the packing sheet cyclically unloaded from the tilting drum and which completes folding of the first flaps of the packing sheet and fastens the first flaps;

wherein said tilting drum includes folding devices arranged longitudinally and parallel to each other between said conveyors, said folding devices structured to laterally guide the group or the product with the packing sheet and fold on the lateral faces of said group or said product the first flaps of said packing sheet with vertical folding, projecting laterally and anterior in the feed direction;

said conveyors and said tilting drum being arranged and controlled such that, following each rotation of said tilting drum said conveyors are reactivated to eject previously fed products and the packing sheet and to introduce a new group or product with the packing sheet coming from said first folding spindle into said tilting drum; and wherein the first folding spindle comprises a lower wall fixed and coplanar with a lower plate or conveyor of the feed unit and comprises an upper wall or conveyor coplanar with an upper wall of said feed unit and which is connected by an adjusting device to adjust position in height when format of the products to be packed varies.

9. A machine for packing groups of products or products of prismatic shape having a rectangular or square base, for implementation of a method for packing the groups of products or the products comprising moving said groups of products or said products from a feed or grouping unit towards a first folding spindle so as to be delivered therefrom wrapped substantially in a shape of a "U" rotated through 90° and open at back, by a packing sheet which is present in front of said spindle with vertical positioning, wherein the groups or the products along with the packing sheet are delivered from said spindle and picked up directly and fed in phase between parallel and horizontal motorized conveyors of a tilting drum, wherein folding devices are arranged inside said tilting drum longitudinally, edgewise and parallel with each other; said folding devices laterally guiding the groups of products or the products with the packing sheet and folding on lateral faces of said groups or said products first flaps of said packing sheet with vertical folding, projecting laterally and anterior in feed direction, while said groups or said products are advanced along said tilting drum by said conveyors; wherein said machine comprises:

a feed unit in which a group of products or a product is introduced, which is then fed horizontally in a pre-established direction for a packing cycle;

a first folding spindle positioned laterally to said feed unit and aligned therewith according to said direction;

means for cyclically positioning the packing sheet with vertical arrangement between said feed unit and said spindle, dimensions and placing of said sheet being correlated to a format of the group or the product to be packed;

a motorized pusher which, in correct phase and with alternate movements, pushes the group or the product to be delivered from said feed unit and fed through said folding spindle drawing therewith said packing sheet which in correct phase is released by a relative feed means and wraps the group or the product in a "U" shape rotated through 90° and being open at back;

a tilting drum which with a pair of motorized conveyors receives the group or the product with the packing sheet delivered from said folding spindle and pushed by said pusher, means being provided to cyclically rotate said tilting drum by 180° in one direction around the axis of rotation;

downstream of said tilting drum, means for receiving the group or the product and the packing sheet cyclically unloaded from the tilting drum and which completes folding of the first flaps of the packing sheet and fastens the first flaps;

wherein said tilting drum includes folding devices arranged longitudinally and parallel to each other between said conveyors, said folding devices structured to laterally guide the group or the product with the packing sheet and fold on the lateral faces of said group or said product the first flaps of said packing sheet with vertical folding, projecting laterally and anterior in the feed direction;

said conveyors and said tilting drum being arranged and controlled such that, following each rotation of said tilting drum said conveyors are reactivated to eject previously fed products and the packing sheet and to introduce a new group or product with the packing sheet coming from said first folding spindle into said tilting drum; and wherein side panels of the tilting drum comprise identical toothed wheels supported rotatingly by external uprights of a U-shaped supporting structure, and which are motorized in rigid phase by connection of toothed belts to toothed pulleys of common diameter to a synchronization shaft having ends thereof supported rotatingly by said frame, together with an electric drive motor.

10. The machine as claimed in claim 9, wherein fastened on inner faces of the side panels of the tilting drum, with symmetrical arrangement in relation to the axis of rotation of said tilting drum, are pairs of rectilinear precision guides, sliding on which are precision slides integral with ends of a flat frame which supports the pulleys and the belts placed side by side with and parallel to each other of the conveyors of said tilting drum.

11. The machine as claimed in claim 10, wherein the conveyors of the tilting drum include belts which are driven around pulleys keyed onto shafts external to said flat frame, supported rotatingly thereby and said shafts support, keyed onto a common end, respective identical toothed pulleys one involved with the inner toothing and another with outer toothing of a belt having double toothing, which kinematically connects said pulleys to a pulley positioned coaxially on an inner face of an adjacent side panel of the tilting drum and keyed onto a shaft of an electric motor having electronic control of speed and phase, flanged with a body thereof on an outer face of the upright of a structure that rotatingly supports said side panel, said belt being arranged to follow a sinuous path and driven around other pulleys supported idle by the inner face of said side panel so that said belt is driven with double branches around said pulleys, so that when self-centering variation of spacing between parallel conveyors of the tilting drum takes place, length of said double branches of the belt is modified in an opposite way, so as to maintain said belt correctly stretched.

12. The machine as claimed in claim 10, wherein supported rotatingly parallel to said guides with an intermediate part thereof by said side panels of the tilting drum, are corresponding pairs of screws with right/left thread, which with ends thereof cooperate with casings with corresponding screw nuts and integral with end corner areas of the frames of the conveyors, is provided positive kinematic connections, positioned longitudinally and externally to said frames, the screw nuts of one end being connected in phase with the screw nuts of another end and at a level of a side panel of the tilting drum, the end screw nuts of a corresponding pair of screws are connected to each other by a pair of positive drives, said positive drives comprising gearboxes integral with the frames and each provided with an input axis parallel to the axis of rotation of the tilting drum and facing an adjacent side panel, keyed onto which are corresponding toothed pulleys of a common diameter, driven around which with opposite toothing is a belt with double toothing which derives motion from a control toothed pulley rotating on the axis of rotation of the tilting drum and connected to adjustment means, and idle pulleys supported by said side panel of the tilting drum, said belt made to follow a sinuous path involving said principal pulleys with double branches so that when the self-centering variation of the spacing between the frames of the conveyors takes place, said double branches of the belt being modifiable in length in a simultaneous and opposite way to maintain tension of said belt unchanged.

13. The machine as claimed in claim 12, wherein the toothed pulley that controls adjustment of the spacing of the conveyors of the tilting drum, is keyed onto the output shaft of an epicyclic reduction gear which is mounted rotatingly and coaxially on a hub of the frame which rotatingly supports with bearings the adjacent side panel, and wherein, keyed onto an input shaft of said reduction gear, is a toothed pulley through which a toothed belt is connected to a corresponding toothed pulley keyed onto the input shaft which synchronizes rotation of two of the side panels of the tilting drum and, provided on one side of said input pulley, a pinion keyed axially to the reduction gear and connected through a chain to a corresponding pinion keyed onto an adjustment shaft rotating on said frame and which is rotatable by a manual control or a servocontrol to adjust the spacing between the conveyors of the tilting drum.

14. A machine for packing groups of products or products of prismatic shape having a rectangular or square base, for implementation of a method for packing the groups of products or the products comprising moving said groups of products or said products from a feed or grouping unit towards a first folding spindle so as to be delivered therefrom wrapped substantially in a shape of a "U" rotated through 90° and open at back, by a packing sheet which is present in front of said spindle with vertical positioning, wherein the groups or the products along with the packing sheet are delivered from said spindle and picked up directly and fed in phase between parallel and horizontal motorized conveyors of a tilting drum, wherein folding devices are arranged inside said tilting drum longitudinally, edgewise and parallel with each other; said folding devices laterally guiding the groups of products or the products with the packing sheet and folding on lateral faces of said groups or said products first flaps of said packing sheet with vertical folding, projecting laterally and anterior in feed direction, while said groups or said products are advanced along said tilting drum by said conveyors; wherein said machine comprises:

feed unit in which a group of products or a product is introduced, which is then fed horizontally in a pre-established direction for a packing cycle;

a first folding spindle positioned laterally to said feed unit and aligned therewith according to said direction;

means for cyclically positioning the packing sheet with vertical arrangement between said feed unit and said spindle, dimensions and placing of said sheet being correlated to a format of the group or the product to be packed;

a motorized pusher which, in correct phase and with alternate movements, pushes the group or the product to be delivered from said feed unit and fed through said folding spindle drawing therewith said packing sheet which in correct phase is released by a relative feed means and wraps the group or the product in a "U" shape rotated through 90° and being open at back;

a tilting drum which with a pair of motorized conveyors receives the group or the product with the packing sheet delivered from said folding spindle and pushed by said pusher, means being provided to cyclically rotate said tilting drum by 180° in one direction around the axis of rotation;

downstream of said tilting drum, means for receiving the group or the product and the packing sheet cyclically unloaded from the tilting drum and which completes folding of the first flaps of the packing sheet and fastens the first flaps;

wherein said tilting drum includes folding devices arranged longitudinally and parallel to each other between said conveyors, said folding devices structured to laterally guide the group or the product with the packing sheet and fold on the lateral faces of said group or said product the first flaps of said packing sheet with vertical folding, projecting laterally and anterior in the feed direction;

said conveyors and said tilting drum being arranged and controlled such that, following each rotation of said tilting drum said conveyors are reactivated to eject previously fed products and the packing sheet and to introduce a new group or product with the packing sheet coming from said first folding spindle into said tilting drum; and wherein the frame which rotatingly supports the tilting drum is mounted sliding vertically with groups of precision guides and slides, on uprights of a bed structure which is connected to a cross-member above said frame by a pair of vertical mechanical jacks with screw-screw nut, synchronized by a drive transmission, which by a first positive drive transmission is connected kinematically to said adjustment shaft to provide adjustment of the spacing between the conveyors of the tilting drum and simultaneously modify the positioning in height of said tilting drum to maintain a lower one of said conveyors in coplanar alignment with a lower plate of the first folding spindle.

15. The machine as claimed in claim 14, wherein the drive transmission that synchronizes said jacks is connected by a second positive drive transmission to a synchronization shaft mounted rotatingly on the frame and which through conical gear couplings rotates a pair of vertical shafts supported rotatingly by bushings integral with said frame, said vertical shafts being provided superiorly with identical threads which cooperate with screw nuts integral with lateral supporting brackets of an upper plate of said first folding spindle, so that when the spacing between the conveyors of the tilting drum varies, distance of the upper plate of said spindle in relation to the lower plate respective thereto is also automatically varied in conformance to the format of product to be packed.

16. The machine as claimed in claim 15, wherein between said drive transmission and the synchronization shaft is provided an engaging and disengaging device, which operatively serves to release said shaft and prepare said shaft for rotation to adapt dimensional characteristics of the first folding spindle to the format of the product to be packed.

17. A machine for packing groups of products or products of prismatic shape having a rectangular or square base, for implementation of a method for packing the groups of products or the products comprising moving said groups of products or said products from a feed or grouping unit towards a first folding spindle so as to be delivered therefrom wrapped substantially in a shape of a "U" rotated through 90° and open at back, by a packing sheet which is present in front of said spindle with vertical positioning, wherein the groups or the products along with the packing sheet are delivered from said spindle and picked up directly and fed in phase between parallel and horizontal motorized conveyors of a tilting drum, wherein folding devices are arranged inside said tilting drum longitudinally, edgewise and parallel with each other; said folding devices laterally guiding the groups of products or the products with the packing sheet and folding on lateral faces of said groups or said products first flaps of said packing sheet with vertical folding, projecting laterally and anterior in feed direction, while said groups or said products are advanced along said tilting drum by said conveyors; wherein said machine comprises:

a feed unit in which a group of products or a product is introduced, which is then fed horizontally in a pre-established direction for a packing cycle;

a first folding spindle positioned laterally to said feed unit and aligned therewith according to said direction;

means for cyclically positioning the packing sheet with vertical arrangement between said feed unit and said spindle, dimensions and placing of said sheet being correlated to a format of the group or the product to be packed;

a motorized pusher which, in correct phase and with alternate movements, pushes the group or the product to be delivered from said feed unit and fed through said folding spindle drawing therewith said packing sheet which in correct phase is released by a relative feed means and wraps the group or the product in a "U" shape rotated through 90° and being open at back;

a tilting drum which with a pair of motorized conveyors receives the group or the product with the packing sheet delivered from said folding spindle and pushed by said pusher, means being provided to cyclically rotate said tilting drum by 180° in one direction around the axis of rotation;

downstream of said tilting drum, means for receiving the group or the product and the packing sheet cyclically unloaded from the tilting drum and which completes folding of the first flaps of the packing sheet and fastens the first flaps;

wherein said tilting drum includes folding devices arranged longitudinally and parallel to each other between said conveyors, said folding devices structured to laterally guide the group or the product with the packing sheet and fold on the lateral faces of said group or said product the first flaps of said packing sheet with vertical folding, projecting laterally and anterior in the feed direction;

said conveyors and said tilting drum being arranged and controlled such that, following each rotation of said tilting drum said conveyors are reactivated to eject previously fed products and the packing sheet and to introduce a new group or product with the packing sheet coming from said first folding spindle into said tilting drum; and wherein the folding devices which operate laterally inside the tilting drum include on an outer face thereof pairs of rods that slide guidedly and manually adjustable inside tubes, and are also fastened at another end on an inner face of the side panels of said tilting drum.

18. A machine for packing groups of products or products of prismatic shape having a rectangular or square base, for implementation of a method for packing the groups of products or the products comprising moving said groups of products or said products from a feed or grouping unit towards a first folding spindle so as to be delivered therefrom wrapped substantially in a shape of a "U" rotated through 90° and open at back, by a packing sheet which is present in front of said spindle with vertical positioning, wherein the groups or the products along with the packing sheet are delivered from said spindle and picked up directly and fed in phase between parallel and horizontal motorized conveyors of a tilting drum, wherein folding devices are arranged inside said tilting drum longitudinally, edgewise and parallel with each other; said folding devices laterally guiding the groups of products or the products with the packing sheet and folding on lateral faces of said groups or said products first flaps of said packing sheet with vertical folding, projecting laterally and anterior in feed direction, while said groups or said products are advanced along said tilting drum by said conveyors; wherein said machine comprises:

a feed unit in which a group of products or a product is introduced, which is then fed horizontally in a pre-established direction for a packing cycle;

a first folding spindle positioned laterally to said feed unit and aligned therewith according to said direction;

means for cyclically positioning the packing sheet with vertical arrangement between said feed unit and said spindle, dimensions and placing of said sheet being correlated to a format of the group or the product to be packed;

a motorized pusher which, in correct phase and with alternate movements, pushes the group or the product to be delivered from said feed unit and fed through said folding spindle drawing therewith said packing sheet which in correct phase is released by a relative feed means and wraps the group or the product in a "U" shape rotated through 90° and being open at back;

a tilting drum which with a pair of motorized conveyors receives the group or the product with the packing sheet delivered from said folding spindle and pushed by said pusher, means being provided to cyclically rotate said tilting drum by 180° in one direction around the axis of rotation;

downstream of said tilting drum, means for receiving the group or the product and the packing sheet cyclically unloaded from the tilting drum and which completes folding of the first flaps of the packing sheet and fastens the first flaps;

wherein said tilting drum includes folding devices arranged longitudinally and parallel to each other between said conveyors, said folding devices structured to laterally guide the group or the product with the packing sheet and fold on the lateral faces of said group or said product the first flaps of said packing sheet with vertical folding, projecting laterally and anterior in the feed direction;

said conveyors and said tilting drum being arranged and controlled such that, following each rotation of said tilting drum said conveyors are reactivated to eject previously fed products and the packing sheet and to introduce a new group or product with the packing sheet coming from said first folding spindle into said tilting drum; and wherein on an unloading end of the tilting drum, parallel and under a lower conveyor of said tilting drum, is present a suction bar which maintains a last inferior flap of the packing sheet longitudinally stretched, so that the last inferior flap is correctly placed on a portion of said packing sheet already wound around the product, while the product is unloaded from the tilting drum.

19. A machine for packing groups of products or products of prismatic shape having a rectangular or square base, for implementation of a method for packing the groups of products or the products comprising moving said groups of products or said products from a feed or grouping unit towards a first folding spindle so as to be delivered therefrom wrapped substantially in a shape of a "U" rotated through 90° and open at back, by a packing sheet which is present in front of said spindle with vertical positioning, wherein the groups or the products along with the packing sheet are delivered from said spindle and picked up directly and fed in phase between parallel and horizontal motorized conveyors of a tilting drum, wherein folding devices are arranged inside said tilting drum longitudinally, edgewise and parallel with each other; said folding devices laterally guiding the groups of products or the products with the packing sheet and folding on lateral faces of said groups or said products first flaps of said packing sheet with vertical folding, projecting laterally and anterior in feed direction, while said groups or said products are advanced along said tilting drum by said conveyors; wherein said machine comprises:

a feed unit in which a group of products or a product is introduced, which is then fed horizontally in a pre-established direction for a packing cycle;

a first folding spindle positioned laterally to said feed unit and aligned therewith according to said direction;

means for cyclically positioning the packing sheet with vertical arrangement between said feed unit and said spindle, dimensions and placing of said sheet being correlated to a format of the group or the product to be packed;

a motorized pusher which, in correct phase and with alternate movements, pushes the group or the product to be delivered from said feed unit and fed through said folding spindle drawing therewith said packing sheet which in correct phase is released by a relative feed means and wraps the group or the product in a "U" shape rotated through 90° and being open at back;

a tilting drum which with a pair of motorized conveyors receives the group or the product with the packing sheet delivered from said folding spindle and pushed by said pusher, means being provided to cyclically rotate said tilting drum by 180° in one direction around the axis of rotation;

downstream of said tilting drum, means for receiving the group or the product and the packing sheet cyclically unloaded from the tilting drum and which completes folding of the first flaps of the packing sheet and fastens the first flaps;

wherein said tilting drum includes folding devices arranged longitudinally and parallel to each other between said conveyors, said folding devices structured to laterally guide the group or the product with the packing sheet and fold on the lateral faces of said group or said product the first flaps of said packing sheet with vertical folding, projecting laterally and anterior in the feed direction;

said conveyors and said tilting drum being arranged and controlled such that, following each rotation of said tilting drum said conveyors are reactivated to eject previously fed products and the packing sheet and to introduce a new group or product with the packing sheet coming from said first folding spindle into said tilting drum; and wherein downstream of and in coplanar alignment with the conveyors of the tilting drum is provided a pair of horizontal belt conveyors, adjustable according to format of the group of products or the product, placed one over the other in parallel and motorized to run with inner branches thereof away from said tilting drum and at a common speed with the conveyors, wherein a space is provided between said conveyors, laterally thereto and at a level of said tilting drum, with longitudinal arrangement, folding means comprising a portion closer to the tilting drum, guided and moving horizontally under action of actuators and which comprise a fixed posterior portion, and means so that, before the group or the product is unloaded from the tilting drum, said moving part of the folding devices downstream are moved towards an end of the lateral folding devices of the tilting drum to be positioned as a bridge and on an outside thereof, to facilitate subsequent feed of the group or the product with the packing sheet during unloading from said tilting drum.

20. The machine as claimed in claim 19, wherein a lower one of said belt conveyors is provided in an intermediate part with a crosswise gap defined by driving said lower one of said belt conveyors around a plurality of parallel rollers and placed crosswise in said gap is a heat-sealing bar which is lifted and lowered to reciprocally seal two overlapping parts of the packing sheet that wraps the groups or the products in a tube, using as counter-roller a product of said groups or said products and a means that temporarily stop said conveyors when a packed group or product of the groups or products transported reaches a pre-selected position in relation to said heat-sealing bar.

21. The machine as claimed in claim 20, wherein, on sides of said belt conveyors, are provided static folding devices which make use of feed movement of the groups or the products during packing to fold in succession lateral flaps with vertical folding, first a lower lateral flap with horizontal folding and then an upper and opposite lateral flap.

22. The machine as claimed in claim 21, wherein downstream of said pair of belt conveyors is provided a horizontal belt conveyor aligned and coplanar with the lower one of the conveyors upstream and which runs in a common direction and at a common speed, and laterally to said conveyor is provided a pair of parallel conveyors with vertical axis between which heating sources operate to perform heat-sealing of the lateral and overlapping flaps of the packing sheet which are retained and made to advance without slip between the conveyors which are synchronized with one another.

* * * * *